US008251368B2

(12) United States Patent
Yach et al.

(10) Patent No.: US 8,251,368 B2
(45) Date of Patent: Aug. 28, 2012

(54) GAME SYSTEM

(76) Inventors: Larry Yach, Carrollton, TX (US); Lee Anne Yach, Carrollton, TX (US)

( * ) Notice: Subject to any disclaimer, the term of this patent is extended or adjusted under 35 U.S.C. 154(b) by 159 days.

(21) Appl. No.: 12/732,117

(22) Filed: Mar. 25, 2010

(65) Prior Publication Data

US 2011/0237362 A1 Sep. 29, 2011

(51) Int. Cl.
*A63B 67/00* (2006.01)

(52) U.S. Cl. ..... 273/342; 473/481

(58) Field of Classification Search ..... 473/481, 473/470; 273/342, 125 R, 125 A, 122 R, 273/122 A, 119 A, 118 R, 118 A, 108.1
See application file for complete search history.

(56) References Cited

U.S. PATENT DOCUMENTS

| | | | | |
|---|---|---|---|---|
| 719,456 | A * | 2/1903 | Gailey | 273/342 |
| 921,366 | A * | 5/1909 | Conolly | 273/352 |
| 2,247,852 | A * | 7/1941 | Saunders | 273/412 |
| 2,444,516 | A * | 7/1948 | Lenbom | 273/317.8 |
| 2,781,194 | A * | 2/1957 | Sistrunk | 473/474 |
| 3,092,387 | A * | 6/1963 | Wagner | 273/317.3 |
| 3,388,909 | A * | 6/1968 | Woods | 473/472 |
| 3,580,578 | A * | 5/1971 | McCarthy | 473/471 |
| 3,668,814 | A * | 6/1972 | Freerks et al. | 451/59 |
| 3,689,069 | A * | 9/1972 | Rogers et al. | 273/317.3 |
| 3,761,089 | A * | 9/1973 | Slane | 273/342 |
| 3,872,623 | A * | 3/1975 | Spaulding, Jr. | 49/169 |
| 3,951,409 | A * | 4/1976 | Drohomirecky | 273/342 |
| 3,992,006 | A * | 11/1976 | Barlow | 273/317.4 |
| 4,239,214 | A * | 12/1980 | Brenner | 273/342 |
| 5,472,189 | A * | 12/1995 | Pfeiffer et al. | 221/155 |
| 2011/0237362 | A1* | 9/2011 | Yach et al. | 473/481 |

* cited by examiner

*Primary Examiner* — Gene Kim
*Assistant Examiner* — M Chambers
(74) *Attorney, Agent, or Firm* — Shannon W. Bates; Klemchuk Kubasta LLP

(57) ABSTRACT

A game system having a frame supporting a hoop wall, bounce floor, bounce wall and ball return floor. The hoop wall has a cutout and multiple hoops facing the bounce wall. The hoops are vertically clear of one another. A plurality of balls is used to play the game. A score is made when a ball is thrown from behind the hoop wall towards the bounce floor and off the bounce wall reversing direction into a hoop.

18 Claims, 7 Drawing Sheets

GAME SYSTEM

The disclosure relates generally to games, and in particular to ball game systems.

BACKGROUND

Game systems are used for entertainment and amusement and may include pinball, video games, skee ball and basketball games.

SUMMARY

Embodiments of the present disclosure generally provide an entertainment device in the form of a ball game.

A game system having a frame supporting a hoop wall, bounce floor, bounce wall and ball return floor. The hoop wall has a cutout and multiple hoops facing the bounce wall. The hoops are vertically clear of one another. A plurality of balls is used to play the game. A score is made when a ball is thrown from behind the hoop wall towards the bounce floor and off of the bounce wall reversing course and into a hoop.

Other technical features may be readily apparent to one skilled in the art from the following figures, descriptions and claims.

BRIEF DESCRIPTION OF THE DRAWINGS

For a more complete understanding of this disclosure and its features, reference is now made to the following description, taken in conjunction with the accompanying drawings, in which.

DETAILED DESCRIPTION

The present disclosure generally provides a game system that allows for challenging ball play within an enclosed field of play.

Figure 1:
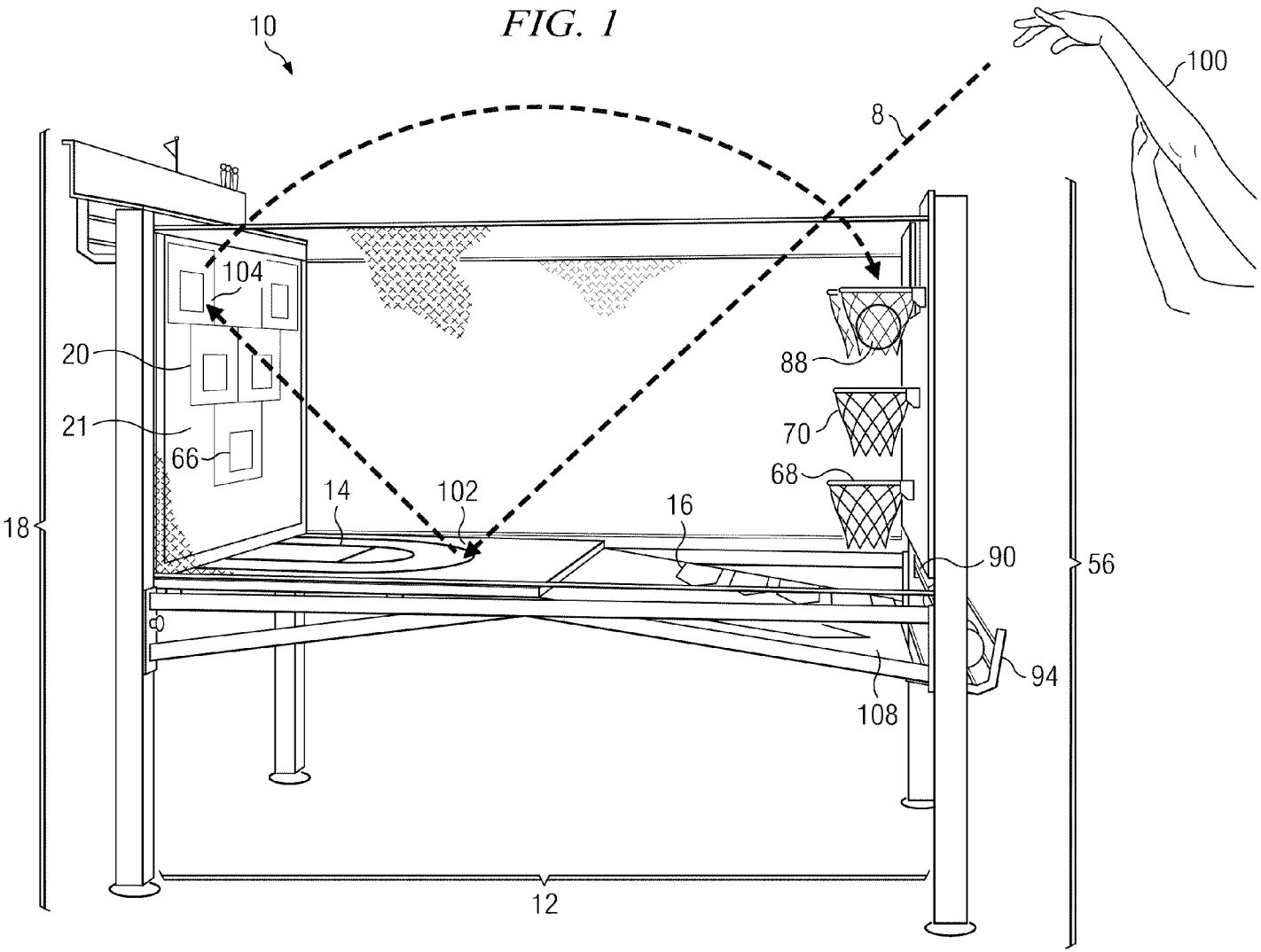
FIG. 1 is a side perspective view of the game system showing the intended path of a ball in play and the location of the player.

FIG. 1 is a side perspective view of the game system showing a game table 10, intended path of a ball in play 8 and the location of a player 100. The game table 10 is comprised of three major structures: a center frame 12, a bounce wall frame 18, and a hoop wall frame 56. The center frame 12 supports the bounce floor 14 and ball return floor 16. The bounce wall frame 18 supports the bounce wall 20. The hoop wall frame 56 supports the hoop wall 64 and hoops 68.

In play player 100 stands behind hoop wall 64 and throws a ball 88 over the hoop wall 64 towards bounce floor 14 as shown by ball path 8. Ball 88 bounces 102 off of floor 14 and hits 104 bounce wall 20. Ball 88 then returns towards hoop wall 64 and hoops 68. Each hoop 68 has a different hoop value 66 and a score is tallied for the shot based on which hoop 68 the ball 88 enters net 70 and remains.

Each hoop 68 may have a hanging net 70 to simulate a basketball net and to contain the ball 88 in the net 70 after a successful shot. Ball 88 will either be missed and falls on ball return floor 16 which is angled slightly toward ball gate 90 and ball rack 94, or shot is made and the ball remains in net 70 until player removes it and drops it on the ball return floor 16 after play ends for that period of play. Ball gate 90 is then lifted and balls 88 roll to ball rack 94 to prepare for next period of play or next player's 100 turn.

Bounce wall 20 may have bounce wall markings 21 to assist in aiming and also shows hoop values 66 to assist in score keeping. Ball return floor 16 may have markings 108 to assist with game play and score keeping.

Figure 2:
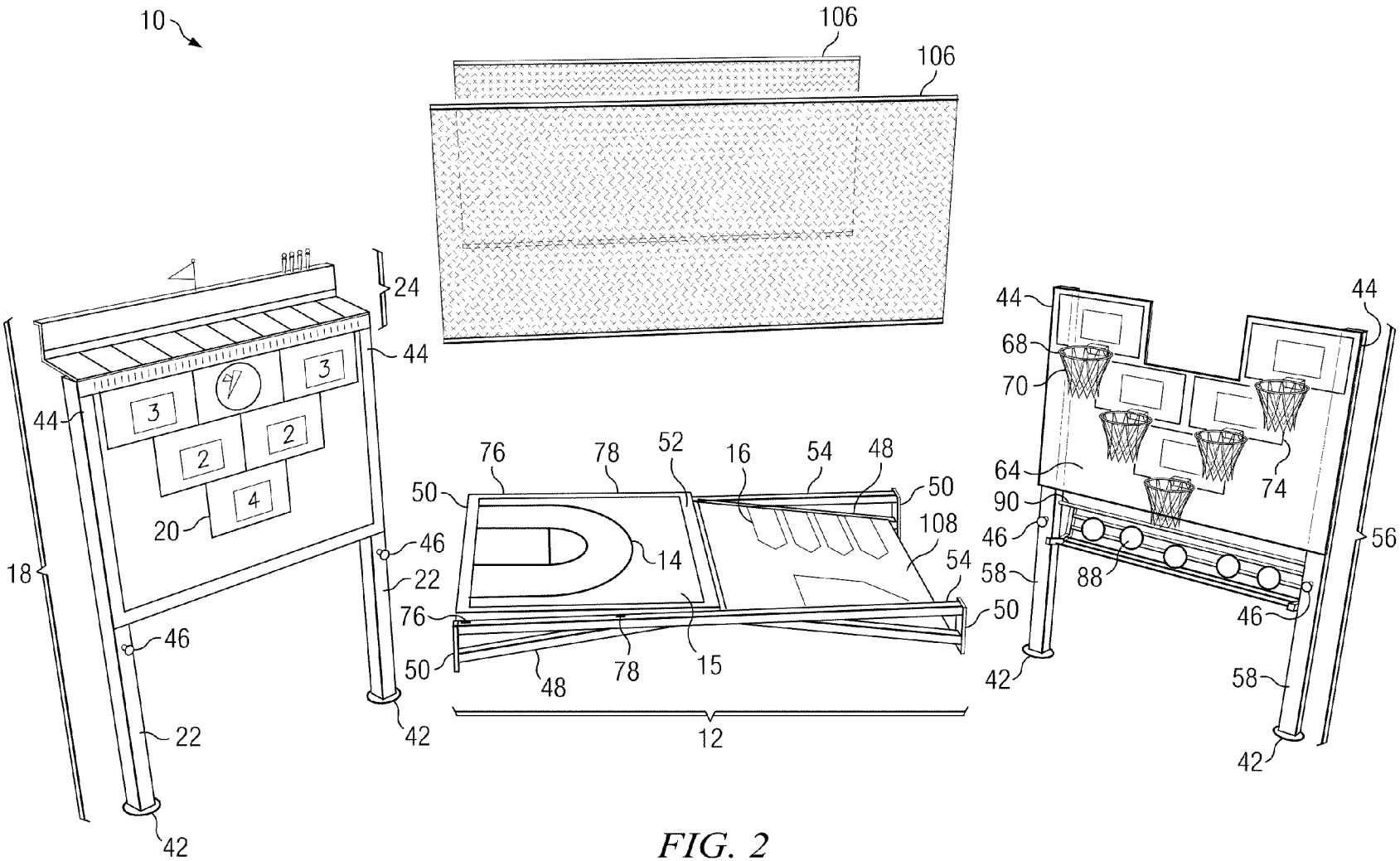
FIG. 2 is a side perspective view of the game system partially disassembled.

FIG. 2 is a side perspective view of the game table 10 partially disassembled as may be desired for storage or relocation. From this view the bounce floor 14, ball return floor 16, bounce wall 20, and hoop wall 64 are more clearly seen.

Atop bounce wall 20 is scoreboard structure 24 and storage rack 26. Bounce wall frame 18 is most visibly made up of bounce frame legs 22 which extend from adjustable feet 42 all the way to the top of bounce wall 20. Along legs 22 are leg knobs 46, which support center frame 12 by engaging mating frame connectors 50, and net hooks 44 which support side nets 106. Side nets 106 cover each side to ensure that balls 88 do not go outside the game table 10 when played.

Hoop wall frame 56 has hoop frame legs 58 that extend from adjustable feet 42 to the top of hoop wall 64. Frame legs 58 each have leg knobs 46 and net hooks 44, similar to bounce frame legs. Hoop wall 64 includes a cutout 65 to allow a good view of the bounce floor 14 and bounce wall 20.

Hoop wall 64 also has multiple hoops 68 that are vertically clear of one another. Each hoop 68 represents a different scoring value and because the hoops 68 are vertically clear of one another each hoop is possible to hit directly with a ball 88. The nets 70 are tapered so balls 88, when made, remains in net 70 until removed.

Figure 3A:
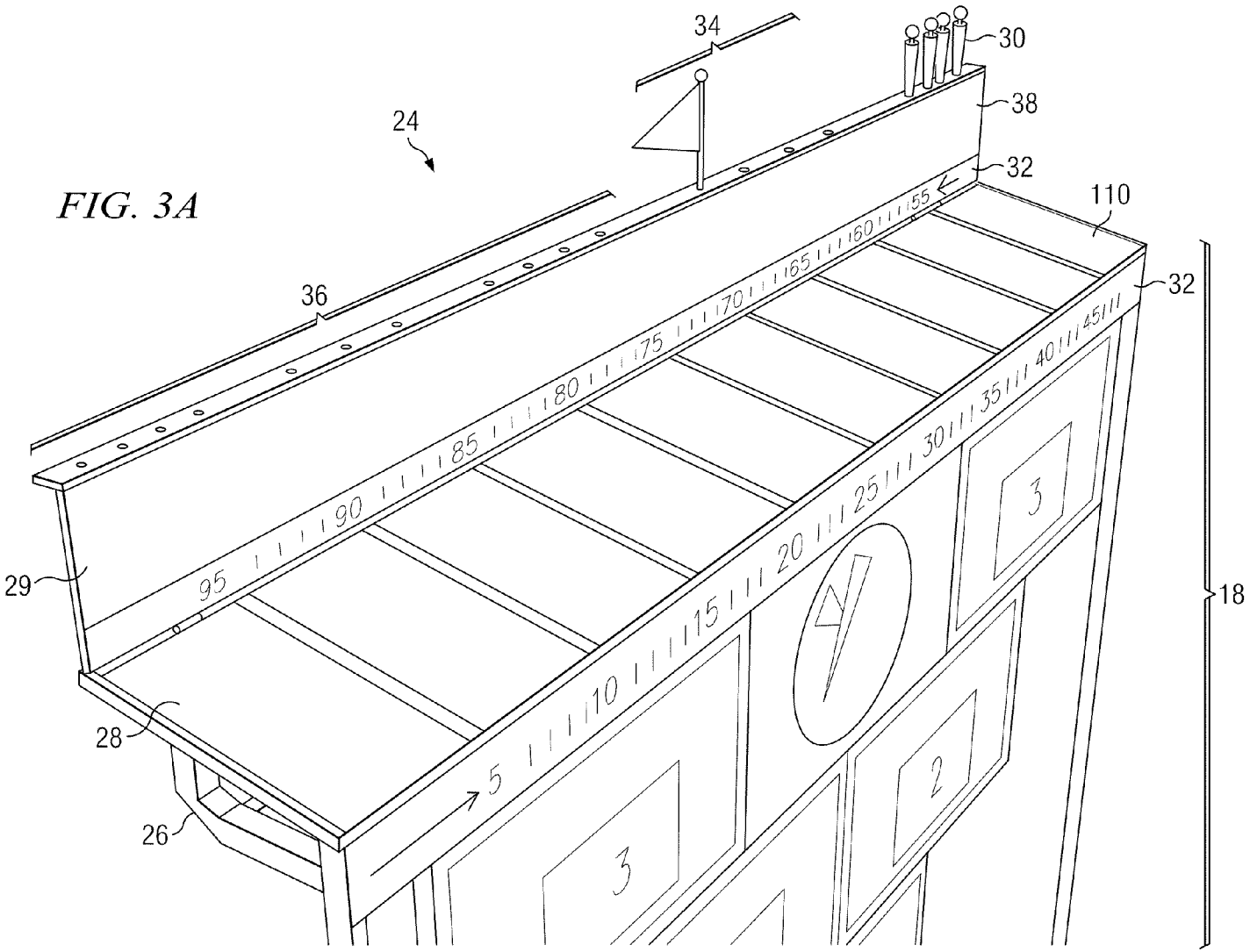
FIG. 3*a* is a perspective view of the scoreboard of the game system.

FIG. 3*a* is a perspective view of the scoreboard 24 of the game system. The scoreboard 24 is based on pegs 30 that are placed in scoring holes 28 in scoreboard lid 110 and backboard 29. Pegs 30 start in peg starting holes 38 and move down to scoring holes 28 as scores are made and accumulated. After reaching a high score the pegs move to the high score holes 36. Playing time is measured based on a peg moved in the playing time holes 34 also along the backboard 29. Scoring 32 is marked alongside the scoring holes 28 and high score holes 36.

Figure 3B:
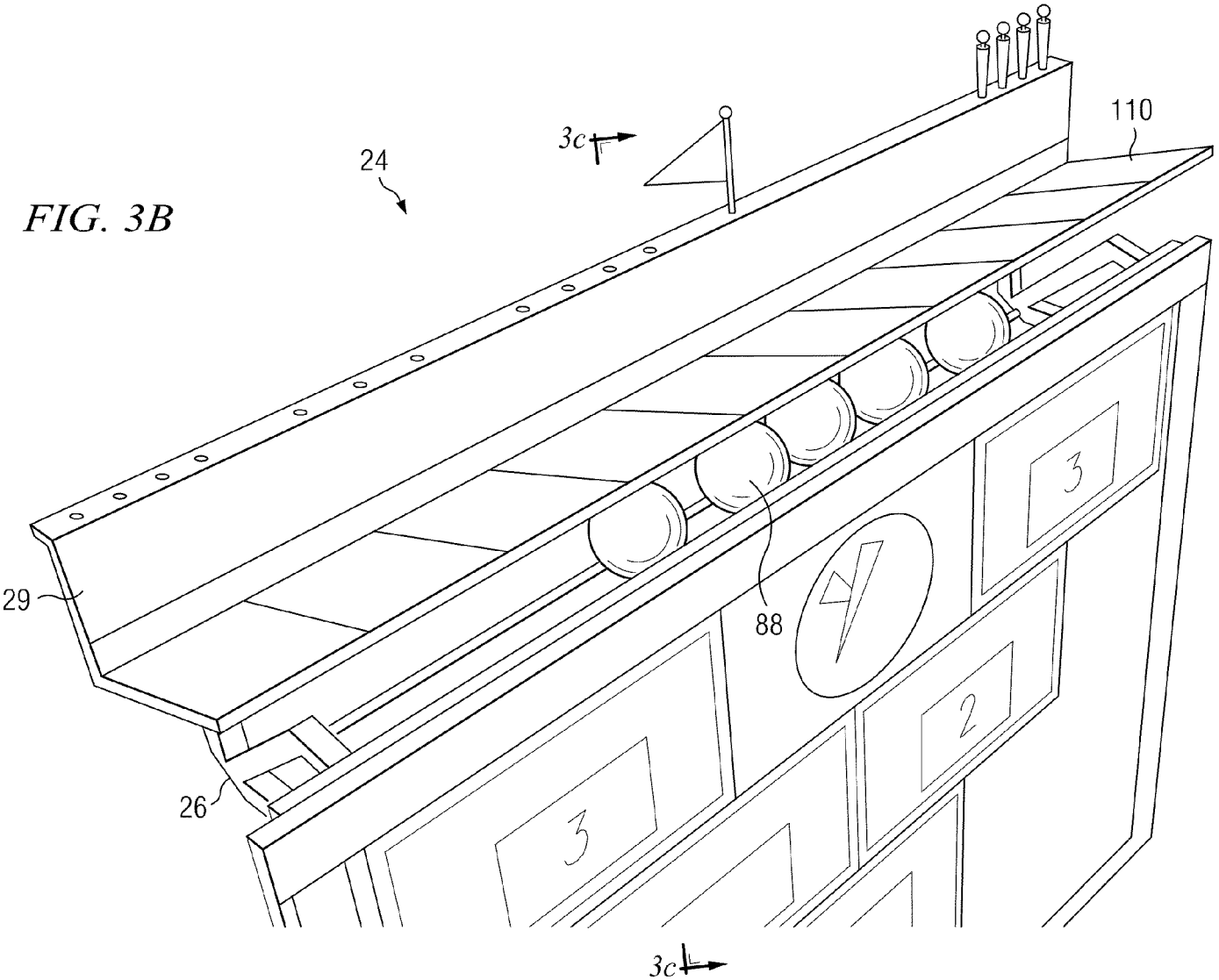
FIG. 3*b* is a perspective view of the scoreboard opened to show a ball storage rack.

FIG. 3*b* is a perspective view of the scoreboard lid 110 opened to show a ball storage rack 26. Ball storage rack 26 provides storage for several balls 88 in a convenient position.

Figure 3C:
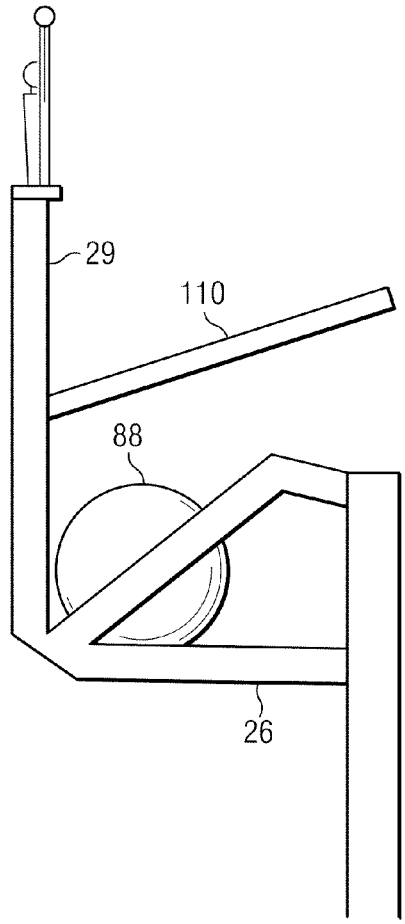
FIG. 3*c* is a rear perspective view of the ball storage rack and scoreboard.
Figure 3D:
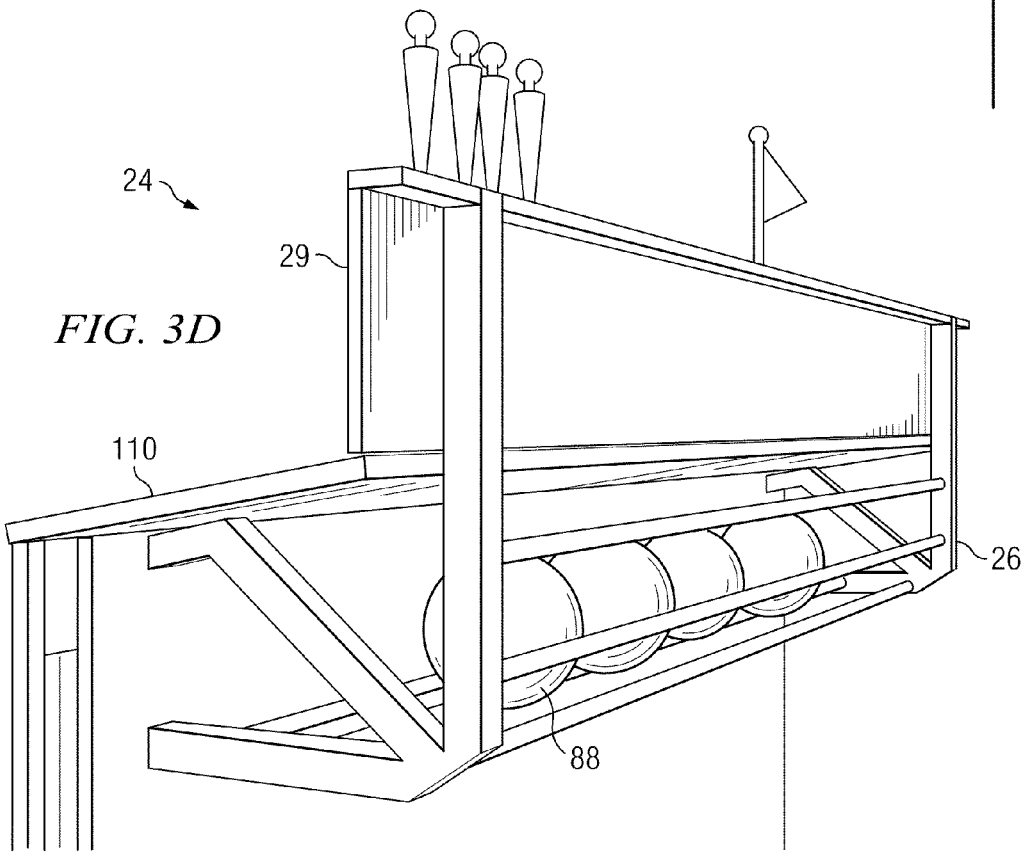

FIG. 3*c* is a rear perspective view of the ball storage rack 26 and scoreboard lid 110. Rack 26 supports backboard 29 and scoreboard lid 100 on the top end of bounce wall 18.

Figure 4:
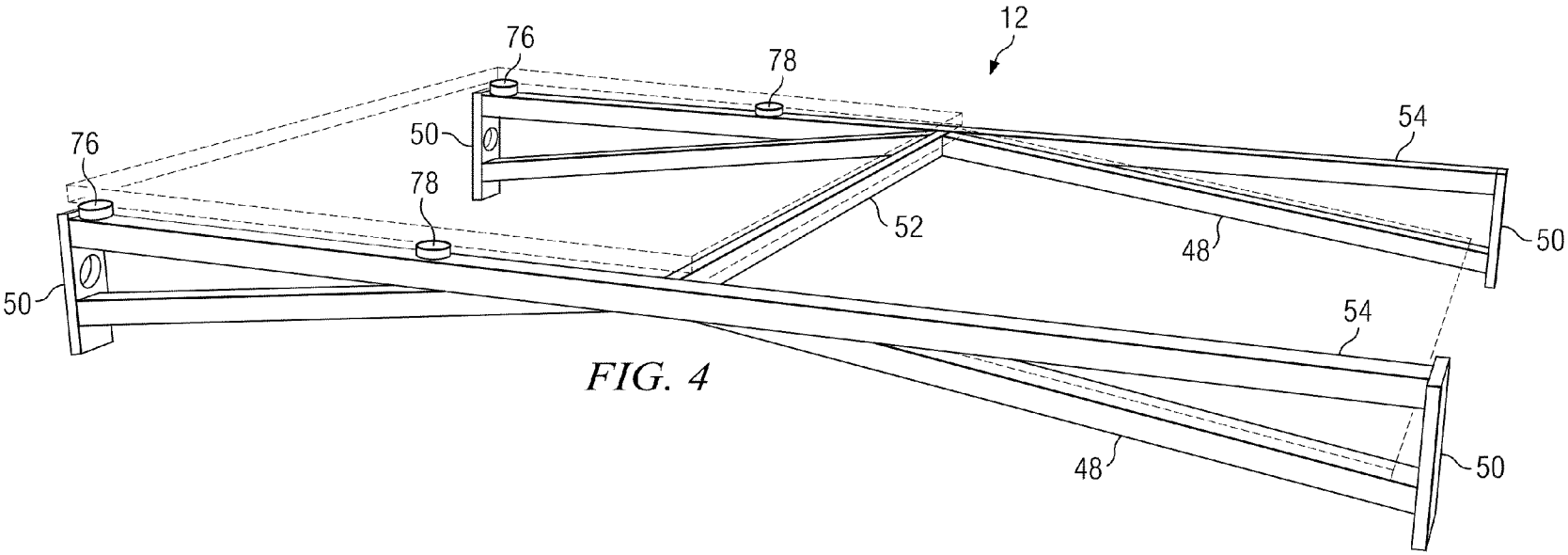
FIG. 4 is a side perspective view of the center frame.

FIG. 4 is a side perspective view of the center frame 12 with frame connectors 50 at each corner and crossbars 54 running the length of frame 12. Center rod 52 connects the crossbars 54 and angle bars 48 provide support to the crossbars 54. Tall spacers 76 and short spacers 78 support bounce floor 14 at a slight angle to allow balls 88 to roll towards ball return floor 16. Ball return floor 16 is supported by angle bars 48 to provide a more rapid return of balls 88 to ball rack 94.

Figure 5A:
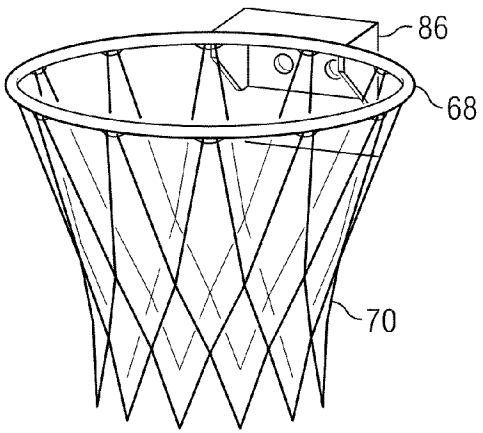
FIG. 5*a* is close up perspective view of a hoop.

FIG. 5*a* is a close up perspective view of a hoop 68. Hoop 68 has a tapered hanging net 70 and is attached to hoop wall 64 by hoop screws 86.

Figure 5B:
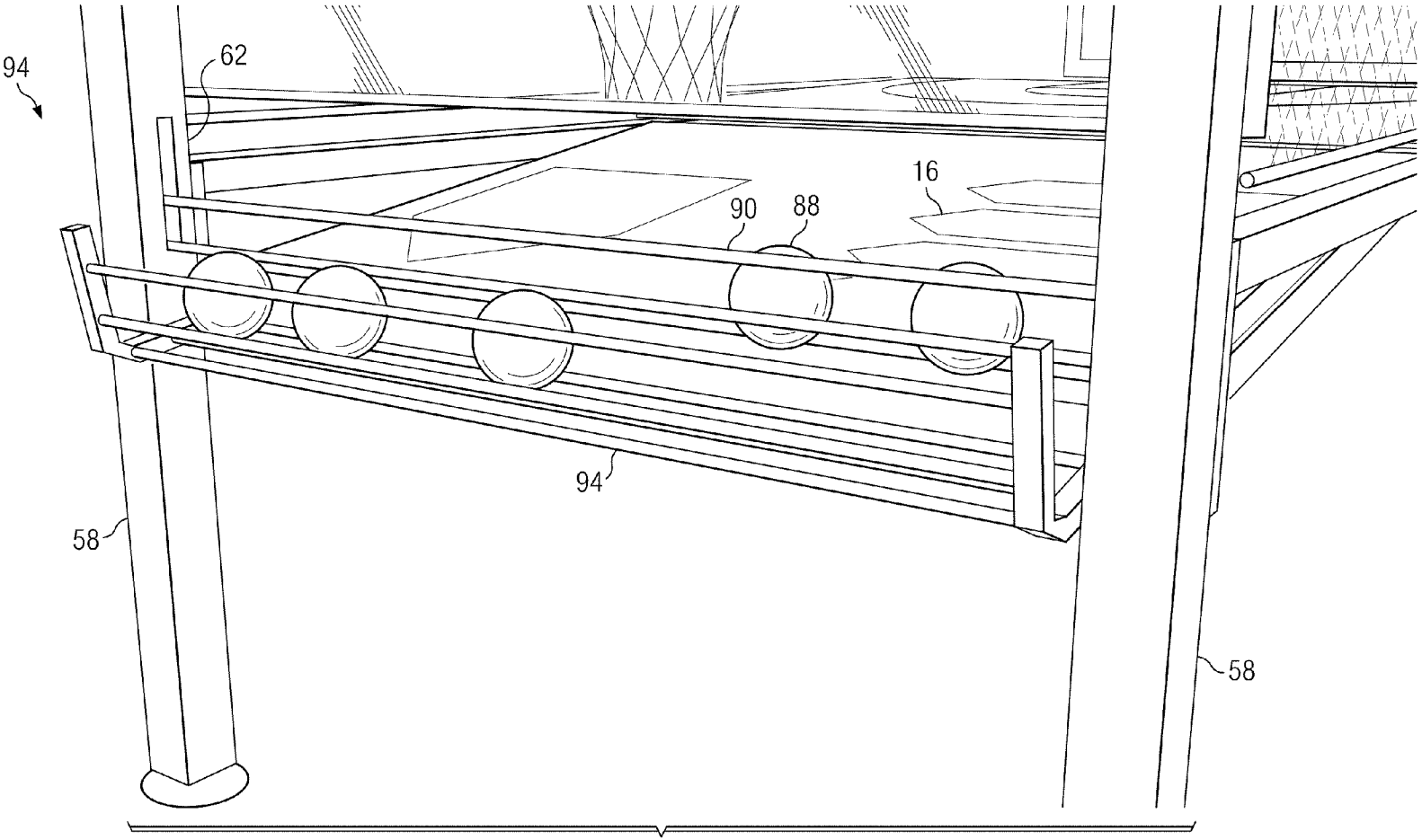
FIG. 5*b* is a close up perspective view of the ball return.

FIG. 5*b* is a close up perspective view of the ball rack 94. Ball return floor 16 is angled to allow balls 88 to roll towards ball gate 90. Ball gate 90 is mounted in hoop frame legs 58 through leg gate holes 62 which allow ball gate 90 to move vertically and allow balls 88 to roll into ball rack 94.

It may be advantageous to set forth definitions of certain words and phrases used in this patent document. The term "couple" and its derivatives refer to any direct or indirect communication between two or more elements, whether or not those elements are in physical contact with one another. The terms "include" and "comprise," as well as derivatives thereof, mean inclusion without limitation. The term "or" is inclusive, meaning and/or. The phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like.

While this disclosure has described certain embodiments and generally associated methods, alterations and permutations of these embodiments and methods will be apparent to those skilled in the art. Accordingly, the above description of example embodiments does not define or constrain this disclosure. Other changes, substitutions, and alterations are also possible without departing from the spirit and scope of this disclosure, as defined by the following claims.

What is claimed is:

1. A game system comprising:

a bounce wall frame having a substantially vertical bounce wall coupled thereto;

a hoop wall frame having a hoop wall coupled thereto;

a hoop coupled to the hoop wall, the hoop facing the bounce wall; and a center frame substantially horizontally disposed between the bounce wall frame and the hoop wall frame, the center frame supporting a substantially horizontal bounce floor and a downwardly angled ball return floor and wherein the bounce floor extends substantially horizontally from a bottom end of the bounce wall and is coupled to the ball return floor, and wherein the ball return floor extends downwardly at an angle from the bounce floor and is coupled to the hoop wall frame at a position below a bottom end of the hoop wall.

2. The game system of claim 1, further comprising a ball rack coupled to the hoop wall frame at a position below the bottom end of the hoop wall and adjacent to the ball return floor.

3. The game system of claim 2, further comprising a ball gate coupled to the ball return floor adjacent to the hoop wall frame.

4. The game system of claim 1, further comprising two side nets, each side net having a first end, a second end and a bottom end;

wherein the first end of each side net is removably coupled to opposite sides of the bounce wall frame, the second end of each side net is removably coupled to opposite sides of the hoop wall frame, and the bottom end of each side net is removably coupled to opposite sides of the center frame.

5. The game system of claim 1, wherein each of the bounce wall frame and the hoop wall frame comprise adjustable legs to raise or lower the overall height of the game system.

6. The game system of claim 1, further comprising a plurality of hoops coupled to the hoop wall, wherein each of the plurality of hoops is vertically clear of one another.

7. A game system having a game table comprising:

a substantially vertical bounce wall;

a hoop wall opposite the bounce wall, the hoop wall supported by a hoop wall frame;

a hoop coupled to the hoop wall, the hoop facing the bounce wall; and a floor disposed between the bounce wall and the hoop wall, wherein the floor comprises a substantially horizontal bounce floor and a downwardly angled ball return floor; and wherein the bounce floor is positioned adjacent the bounce wall and the ball return floor is positioned adjacent the hoop wall and is coupled to the hoop wall frame at a position below a bottom end of the hoop wall.

8. The game system of claim 7, further comprising a gap in a top end of the hoop wall through which a ball is thrown towards the bounce floor.

9. The game table of claim 8, further comprising two side nets, each side net having a first end, a second end and a bottom end;

wherein the first end of each side net is removably coupled to opposite sides of the bounce wall, the second end of each side net is removably coupled to opposite sides of the hoop wall, and the bottom end of each side net is removably coupled to the opposite sides of the floor such that the ball remains on the game table during play.

10. The game system of claim 8, further comprising a scoreboard that registers a score when the ball bounces off the bounce floor towards the bounce wall, and rebounds off the bounce wall across to the hoop wall and into the hoop.

11. The game system of claim 7, further comprising a plurality of hoops coupled to the hoop wall, wherein each of the plurality of hoops is vertically clear of one another.

12. The game system of claim 11, further comprising a scoreboard that registers a different point value depending on which hoop a ball goes into when a ball is bounced off the bounce wall across to the hoop wall and into one of the plurality of hoops.

13. The game table of claim 7, further comprising a ball rack coupled to the hoop wall, wherein the ball rack stores a ball during play.

14. The game table of claim 13, further comprising a ball gate coupled to the ball return floor adjacent to the hoop wall frame, wherein the ball gate receives the ball from the ball return floor and stores the ball until released into the ball rack.

15. A method of playing a game using the game system of claim 6, the method comprising:

bouncing a ball off the bounce floor towards the bounce wall; and rebounding the ball off the bounce wall toward the hoop wall and either into one of the plurality of hoops or onto the ball return floor;

wherein points are scored when the ball enters into one of the plurality of hoops.

16. A method of playing a game using the game table of claim 11, the method comprising:

bouncing the ball off the bounce floor towards the bounce wall; and rebounding the ball off the bounce wall toward the hoop wall, and either into one of the plurality of hoops or onto the ball return floor.

17. The method of claim 16, wherein points are scored when the ball enters into one of the plurality of hoops.

18. The method of claim 17, wherein a different point value is registered depending on which hoop of the plurality of hoops the ball enters.

* * * * *